US010137722B2

(12) United States Patent
Chang et al.

(10) Patent No.: US 10,137,722 B2
(45) Date of Patent: Nov. 27, 2018

(54) CREASE STICKY NOTE

(71) Applicant: MICCUDO MULTIMEDIA CO., LTD., Taipei (TW)

(72) Inventors: Chiao-Chu Chang, Taipei (TW); Wei-Yang Chang, Taipei (TW)

(73) Assignee: Miccudo Multimedia Co., Ltd., Taipei (TW)

( * ) Notice: Subject to any disclaimer, the term of this patent is extended or adjusted under 35 U.S.C. 154(b) by 185 days.

(21) Appl. No.: 15/250,813

(22) Filed: Aug. 29, 2016

(65) Prior Publication Data

US 2017/0057272 A1 Mar. 2, 2017

(30) Foreign Application Priority Data

Aug. 27, 2015 (TW) ..... 104213922 U

(51) Int. Cl.
*B42D 9/00* (2006.01)
*B42D 9/04* (2006.01)
*B42D 5/00* (2006.01)

(52) U.S. Cl.
CPC ..... *B42D 9/007* (2013.01); *B42D 5/003* (2013.01); *B42D 9/04* (2013.01)

(58) Field of Classification Search
CPC . B42D 9/00; B42D 9/007; B42D 9/04; B42D 5/003
USPC ..... 116/234; 281/42
See application file for complete search history.

(56) References Cited

U.S. PATENT DOCUMENTS 5,358,279 A * 10/1994 Sweet ..... B42D 9/007 116/237
6,357,797 B1 * 3/2002 Lee ..... B42D 9/001 281/19.1
6,550,417 B2 * 4/2003 Hendershot ..... B42D 9/008 116/234
6,994,052 B1 * 2/2006 McMullen ..... B42D 9/008 116/234
7,055,861 B1 * 6/2006 Lee ..... B42D 9/005 116/234
2005/0230956 A1 * 10/2005 Igeta ..... B42D 9/004 281/42

FOREIGN PATENT DOCUMENTS

DE 212010000056 U1 * 2/2012 ..... B42D 9/005
JP 7000757 U * 7/1995 ..... B42D 9/00
JP 11011045 A * 1/1999 ..... B42D 9/00
WO WO 8102867 A1 * 10/1981 ..... B42D 9/005

* cited by examiner

*Primary Examiner* — R. A. Smith
(74) *Attorney, Agent, or Firm* — Skaar Ulbrich Macari, P.A.

(57) ABSTRACT

A creased sticky note with a sticky body, an adhesive layer and at least one crease is provided. The sticky body has an adhesion portion and a flexible portion disposed adjacent to the adhesion portion. The adhesive layer is disposed on the adhesion portion. The at least one crease is disposed on the adhesion portion, or is disposed between the adhesion portion and the flexible portion, or is disposed on a stress hinders area of the flexible portion which is near the adhesion portion.

9 Claims, 7 Drawing Sheets

CREASE STICKY NOTE

This application claims priority to Taiwan Patent Application No. 104213922 filed on Aug. 27, 2016.

CROSS-REFERENCES TO RELATED APPLICATIONS

Not applicable.

BACKGROUND OF THE INVENTION

Field of the Invention

The present invention provides a creased sticky note; and in particular, the present invention provides a creased sticky note with at least one crease.

Descriptions of the Related Art

Sticky notes (or self-adhesive memos) have gained popularity among many people, especially among office workers and students, because of its convenience, adherence to surfaces of various files, and use for marking key points. As a result, they are used in specific positions or the like.

Sticky notes can be adhered repeatedly during use. However, when the user wants to separate a single sheet of sticky note from a whole stack of sticky notes, an external force is required to pull up the flexible portion of the sticky body with a weak viscosity from bottom to top. Such an operation results in a bending tension generated on the sticky body, causing the sticky body of the sticky note to warp or flex from the adhesion portion of an adhesive layer or from the lower part of the sticky note that is not sticky after the sticky note is adhered to the surface of a specific object. The warp or flexure would gradually extend to the whole sheet of sticky note with time, which would cause the sticky note to come off of the surface of the specific object.

To prevent the sticky note from coming off, most manufacturers of sticky notes have tried to reduce the paper thickness of a single sheet of sticky note or increasing the area of the adhesive layer or the like.

Although the aforesaid flexure and adhesive problems may be improved by reducing the paper thickness of a single sheet of sticky note or increasing the area of the adhesive layer, unfortunately, the effects do not last. Moreover, enhancing the adhesion effect by increasing the area of the adhesive layer directly increases the cost of the sticky notes.

In addition, for good adhesion performance, the width of the adhesive layer of the sticky notes that are available on the market is usually set to be greater than 12 mm, or occupy more than 15% of the area of the sticky body. Thus, when the sticky note is used for note-taking or recording, the large width of the adhesive layer may to cover other information on the surface of the adhered object and is not conducive for page-turn reading. Furthermore, if the recorded item is too long, there is not enough space to record on both sides.

Accordingly, it is important to provide a creased sticky note, which can effectively prevent the aforesaid flexure and adhesion problems, increase the duration of time for which the sticky note is adhered to the surface of a specific object, reduce production costs, and be widely applied.

SUMMARY OF THE INVENTION

An objective of the present invention is to provide a creased sticky note. The sticky body of the creased sticky note is provided with at least one crease, so when a single sheet of sticky note is pulled up for use, the tension caused by the lifting of the sticky note will be reduced due to the existence of the crease, thereby reducing the possibility of flexure. Furthermore, even if the sticky note flexes from the corner of the flexible portion during use, the force causing the flexure will be blocked by the at least one crease and cannot extend to the adhesion portion, thereby preventing the sticky note from coming off of the surface of the specific object after long term use.

Another objective of the present invention is to provide a creased sticky note. The sticky body of the creased sticky note is provided with at least one crease, so the flexible portion can be allowed to bend along the at least one crease and the flexure can be prevented even if there is only a small area of adhesive layer.

Yet another objective of the present invention is to provide a creased sticky note. The sticky body of the crease sticky note has at least one crease that is formed by a perforation cutter. As a result, the creased sticky note has the following advantages: (1) easy to fold; (2) easy to tear off the flexible portion of the sticky body while maintaining the adhesion portion of the sticky body; and (3) easy to bend along the at least one crease so that the flexible portion of the sticky body can be used in different modes, such as for page-turning purposes. Accordingly, the creased sticky note of the present invention will have the following advantages during use:

- The bending tension of the flexible portion is reduced, thereby enabling the adhesion portion to keep a durable and stable viscosity.
- The area of the adhesive layer is reduced while still maintaining the adhesion strength of the sticky note (the adhesion portion of the sticky note currently available on the market needs a width of about 12 mm to 20 mm to be adhered effectively, while the width of the adhesion portion in the present invention can be lowered to 3 mm by providing the crease while still maintaining the adhesion strength and stability).
- With the crease, the sticky note is capable of being folded easily so that it is more convenient for the flexible portion to be used in a page-turn mode or a double-sided mode.
- Due to the reduction of the adhesion portion, the writable space on the back flexible portion is enlarged. By reducing the area of the adhesion portion, the sticky note can be used between lines of an article, and for taking notes and marking without influencing the text of the underlying paper article because it can be easily folded.

If the aforesaid crease is formed by the perforation cutter, then the flexible portion of the sticky body can be torn off while the remainder of the adhesion portion of the sticky body may be used as a separate marker or for other uses.

To achieve the aforesaid objectives, a creased sticky note provided in the present invention comprises a sticky body, an adhesive layer and at least one crease. The sticky body has an adhesion portion and a flexible portion disposed adjacent to the adhesion portion. The adhesive layer is disposed on the adhesion portion. The crease is optionally disposed on the adhesion portion, or between the adhesion portion and the flexible portion, or on an area of the flexible portion which is near the adhesion portion.

To achieve the aforesaid objectives, when the at least one crease is disposed on the area of the flexible portion, the area of the flexible portion is near the adhesion portion. The area has a width ranging between 1 mm to 10 mm.

To achieve the aforesaid objectives, the adhesive layer of the creased sticky note of the present invention is an adhesive layer capable of being adhered repeatedly.

To achieve the aforesaid objectives, the flexible portion of the creased sticky note of the present invention has a writable area.

To achieve the aforesaid objectives, the at least one crease of the creased sticky note of the present invention is formed by a perforation cutter or an indentation so that the adhesive layer disposed on the adhesion portion has a specific width.

To achieve the aforesaid objectives, the specific width of the creased sticky note of the present invention ranges between 3 mm to 20 mm. To achieve the aforesaid objectives, the specific width of the creased sticky note of the present invention can be 5 mm, 7 mm and 10 mm.

To achieve the aforesaid objectives, the sticky body of the creased sticky note of the present invention can be a page-turn sticky note, a bookmark sticky note, or a pamphlet sticky note.

To achieve the aforesaid objectives, the adhesion portion of the bookmark sticky note included in the creased sticky note of the present invention is adapted to be adhered to the front or back cover of a book via the adhesive layer. Since the flexible portion can be easily bent due to the existence of the crease, the flexible portion is adapted to be bent to be inserted into a specific page of the book for marking.

To achieve the aforesaid objectives, the flexible portion of the bookmark sticky note included in the crease sticky note of the present invention further has a bent section and an inserting section that have different shapes and appearances from each other.

To achieve the aforesaid objectives, the crease of the creased sticky note of the present invention may help to reduce the area of the adhesion portion so that the creased sticky note can have various functions such as being used for note-taking, inserted into pages of a book, used for double-sided writing, or used to mark lines of an article, thereby expanding the original functions of the sticky note and creating a new type of sticky note.

The detailed technology and preferred embodiments implemented for the subject invention are described in the following paragraphs accompanying the appended drawings for people skilled in this field to well appreciate the features of the claimed invention. As can be readily appreciated by those of ordinary skill in the art, although the phrase "sticky note" is used herein for description of related technological contents, the aforesaid phase "sticky note" may also be replaced by terms such as "self-adhesive note," "self-adhesive memo," "sticky memo," "self-adhered note," "index note" or the like.

DESCRIPTION OF THE PREFERRED EMBODIMENT

Figure 1:
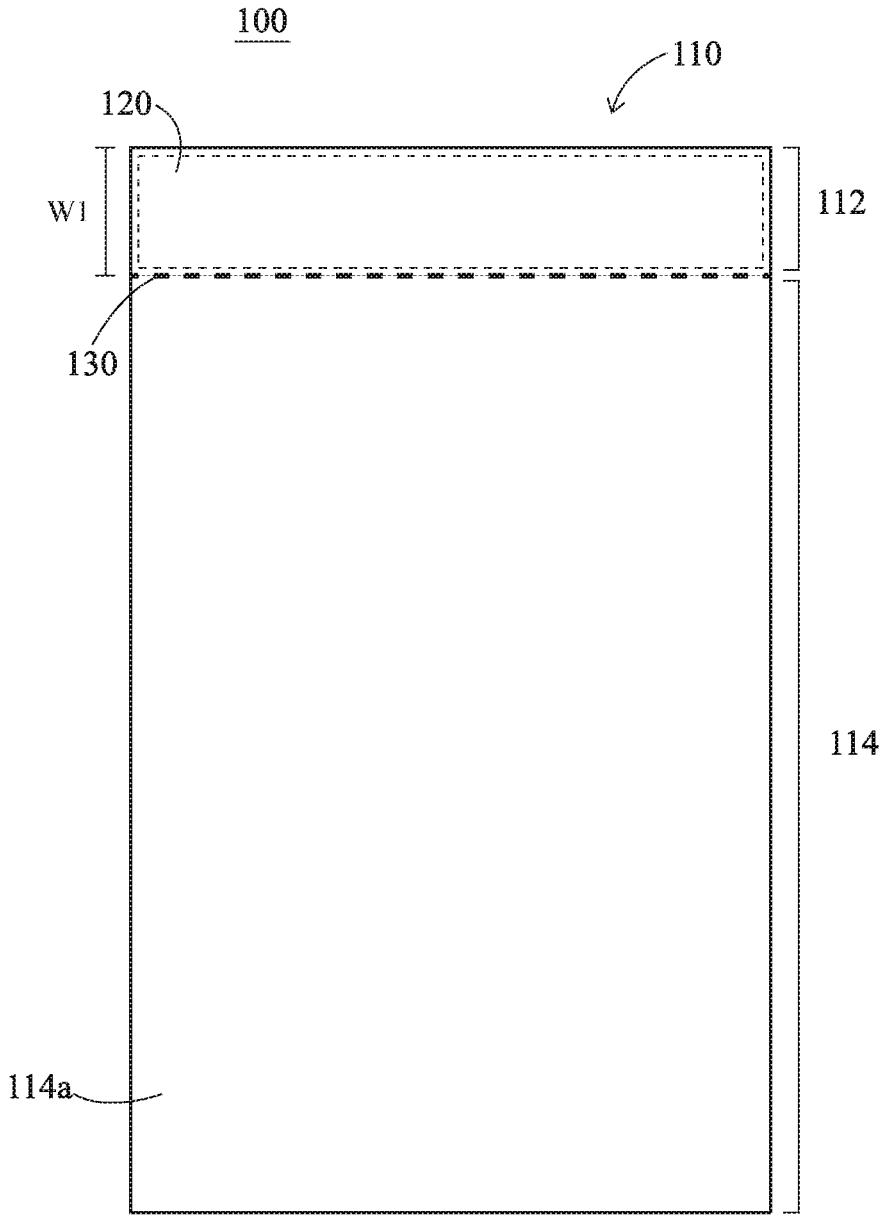
FIG. 1 is a schematic view of the first embodiment of a creased sticky note according to the present invention.

FIG. 1 is a schematic view of the first embodiment of a creased sticky note according to the present invention. The creased sticky note 100 comprises a sticky body 110, an adhesive layer 120 and a crease 130. The sticky body 110 has an adhesion portion 112 and a flexible portion 114 disposed adjacent to the adhesion portion 112. The adhesive layer 120 is disposed on the adhesion portion 112. The crease 130 is disposed between the adhesion portion 112 and the flexible portion 114 to separate the adhesion portion 112 from the flexible portion 114. The aforesaid flexible portion 114 broadly refers to any portion that can be bent and flexed.

As shown in FIG. 1, in the present invention, the flexible portion 114 has a writable area 114*a* for the user to write markings.

The crease 130 of the creased sticky note 100 of the present invention is formed by an indentation or a perforation cutter. In addition, the adhesive layer 120 disposed on the adhesion portion 112 has a specific width W1. The specific width W1 is smaller than the width of the adhesive layer used in the sticky note in the prior art but is still capable of maintaining the duration of time for which the creased sticky note 100 of the present invention is adhered to the surface of a specific object.

Since the crease 130 of the creased sticky note 100 of the present invention is formed by an indentation or a perforation cutter, the crease 130 disposed between the adhesion portion 112 and the flexible portion 114 thus can prevent the flexure stress by extending from the adhesion portion 112 to the flexible portion 114 or extending from the flexible portion 114 to the adhesion portion 112.

In detail, when the creased sticky note 100 of the present invention is used, the adhesion portion 112 of the sticky body 110 will be adhered onto the surface of a specific object via the adhesive layer 120. Thus, due to the use of paper, the flexible portion 114 that is not provided with the adhesive layer 120 will flex from the corner away from the adhesion portion 112 without the action of an external force.

Thereafter, the flexure stress generated by the flexure will gradually extend from the corner of the flexible portion 114 that is away from the adhesion portion 112 towards the adhesion portion 112 without the action of the external force. However, when the flexure stress extends to the crease 130 formed by the perforation cutter, the crease 130 formed by a plurality of gaps (or slots) cut into the sticky body 110 by the perforation cutter will block the flexure stress so that the flexure stress cannot continuously extend to the adhesion portion 112 that is provided by the adhesive layer 120.

Since the crease 130 generated by the perforation cutter may be used to prevent the adhesion portion 112 from being affected by the flexure stress, the area of the adhesive layer in the prior art can be reduced. Moreover, the duration of time for which the creased sticky note 100 of the present invention is adhered onto the surface of a specific object can still be maintained or even prolonged while the amount of the adhesive being used is reduced.

Similarly, when the crease 130 is generated by the indentation, the crease 130 can also be used to prevent the adhesion portion 112 from being affected by the flexure stress, reduce the area of the adhesive layer in the prior art, and prolong the duration of time for which the creased sticky note 100 of the present invention is adhered onto the surface of a specific object.

As shown by experimental results, in an embodiment, the specific width W1 of the adhesive layer 120 disposed on the adhesion portion 112 ranges between 3 mm to 20 mm. In the preferred embodiment, the specific width W1 of the adhesive layer 120 disposed on the adhesion portion 112 is 5 mm, 7 mm or 10 mm.

Thus, as compared to the prior art, the creased sticky note 100 of the present invention can maintain or even prolong the duration of time for which the sticky note is adhered onto the surface of a specific object with a smaller area of an adhesive layer 120. Meanwhile, since the crease 130 generated by the indentation or the perforation cutter can be used to block the flexure stress, the flexible portion 114 of the creased sticky note 100 of the present invention can be used for writing on the front side and the back side thereof (i.e., the writable area 114*a* comprise the front/back sides of the flexible portion 114), or the adhesion relationships between the adhesion portion 112 and the surface of the specific object can still be maintained even if the flexible portion 114 is bent to form an angle of 90 degrees with the adhesion portion 112.

Additionally, it shall be particularly appreciated that although the aspect that is only provided with a single crease 130 is described in the aforesaid embodiments, those of ordinary skill in the art can readily infer other aspects with a plurality of creases 130 from the aspect with the single crease 130, and these aspects in which a plurality of creases 130 are disposed on the sticky body 110 are also within the scope to be claimed by the present invention.

Figure 2:
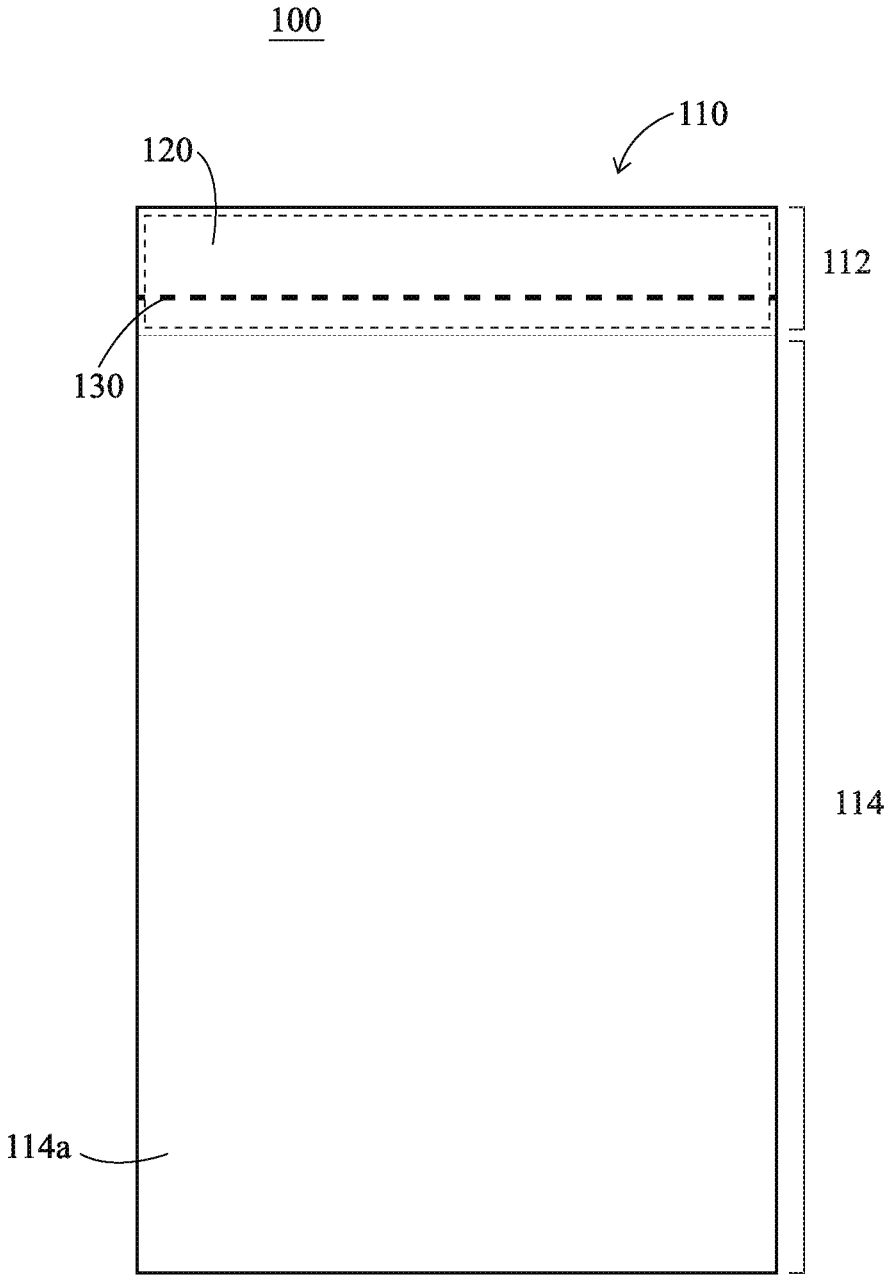
FIG. 2 is a schematic view of the second embodiment of a creased sticky note according to the present invention.

As shown in the second embodiment of FIG. 2, the crease 130 disposed between the adhesion portion 112 and the flexible portion 114 in the first embodiment may also be disposed only on the adhesion portion 112 in this embodiment. The second embodiment of the creased sticky note 100 shown in FIG. 2 also can prevent the flexure stress from extending from the adhesion portion 112 to the flexible portion 114, or extending from the flexible portion 114 to the adhesion portion 112.

Figure 3:
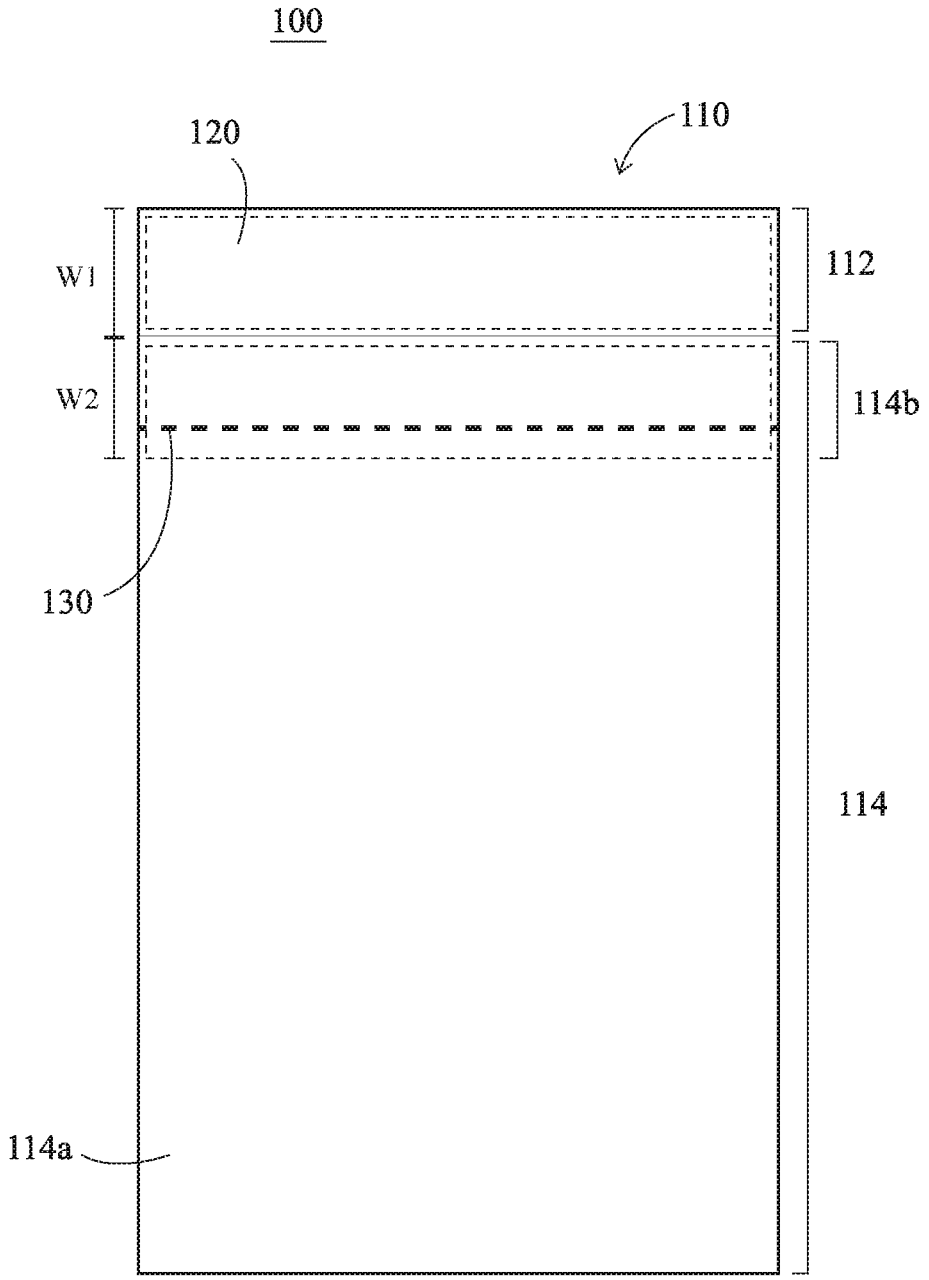
FIG. 3 is a schematic view of the third embodiment of a creased sticky note according to the present invention.

Alternatively, as shown in the third embodiment of FIG. 3, the crease 130 may also be disposed in a stress hinders area 114*b* of the flexible portion 114 which is near the adhesion portion 112, thereby achieving the aforesaid function of preventing the flexure stress from extending from the adhesion portion 112 to the flexible portion 114, or extending from the flexible portion 114 to the adhesion portion 112. As shown in FIG. 3, the stress hinders area 114*b* is a portion of the flexible portion 114 and is the area adjacent to the adhesion portion 112. Additionally, as shown in FIG. 3, the stress hinders area 114*b* preferably has a width W2 ranging from 1 mm to 10 mm.

The embodiments in which the sticky body 110 of the creased sticky note 100 of the present invention is a bookmark sticky note 210 that will be described hereinafter.

Figure 4:
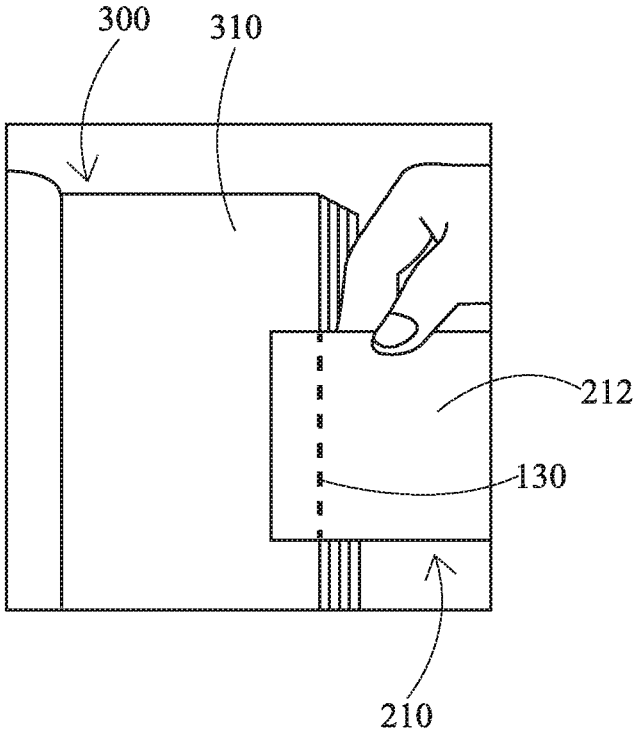
FIG. 4 is a schematic view illustrating the adhesion portion of a bookmark sticky note adhered to a book when the sticky body of the creased sticky note of the present invention is the bookmark sticky note.

As shown in FIG. 4, the bookmark sticky note 210 has an adhesion portion 212 and a flexible portion 214 disposed adjacent to the adhesion portion 212. Therefore, after the adhesive layer 120 is disposed on the adhesion portion 212, the adhesion portion 212 at the end of the bookmark sticky note 210 is adapted to be adhered to a front cover/back cover 310 of a book 300 via the adhesive layer 120. Moreover, as shown in FIG. 5, the flexible portion 214 at the other end of the bookmark sticky note 210 is adapted to be bent to be inserted into a specific page 320 of the book 300 for marking.

Figure 5:
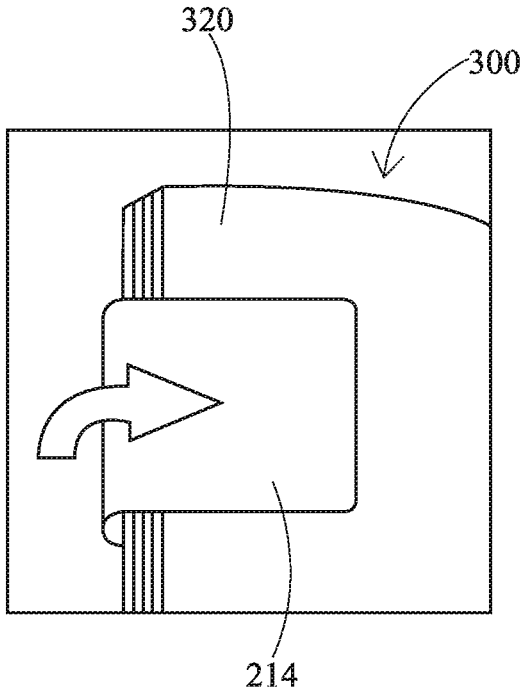
FIG. 5 is a schematic view illustrating the bending of a flexible portion of a bookmark sticky note when the sticky body of the creased sticky note of the present invention is the bookmark sticky note.
Figure 6:
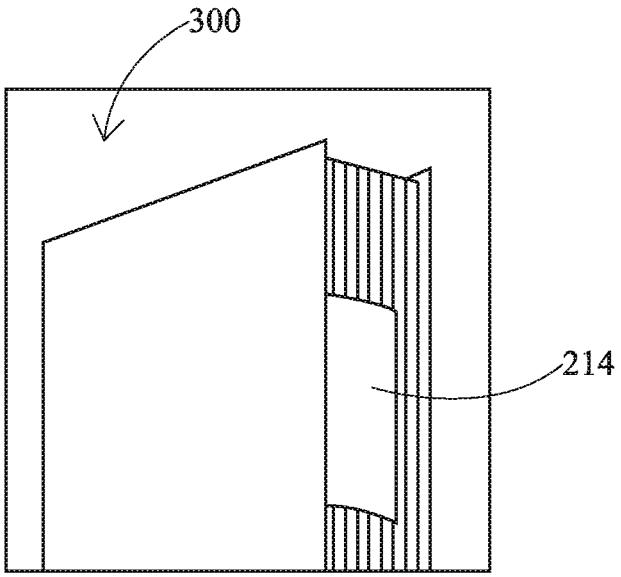
FIG. 6 is a schematic view illustrating the use of the creased sticky note of the present invention when the sticky body of the creased sticky note is the bookmark sticky note.

In this way, when the user reads the book 300 to a specific progress or a specific page 320, he/she can bend and insert the flexible portion 214 into the specific page 320 of the book 300 for marking as shown in FIG. 5 so that he/she can conveniently return to the specific page for reading in the future after closing the book 300.

In the present invention, since the adhesive layer 220 of the bookmark sticky note 210 is an adhesive layer capable of being adhered repeatedly, the bookmark sticky note 210 can be used repeatedly. Moreover, the adhesive layer capable of being adhered repeatedly may help to avoid damage to the front cover/back cover 310 or the specific page 320 of the book 300 during the process of adhering or tearing off the bookmark sticky note 210.

It shall be appreciated that as shown in the embodiment of FIG. 3, the bookmark sticky note 210 has a rectangular shape. By the aforesaid restriction on the specific width of the adhesive layer 120, the adhesion portion 212 can be well adhered to the front cover/back cover 310 of the book 300 during use, thereby, effectively preventing the bookmark sticky note 210 from coming off the book 300.

Figure 7:
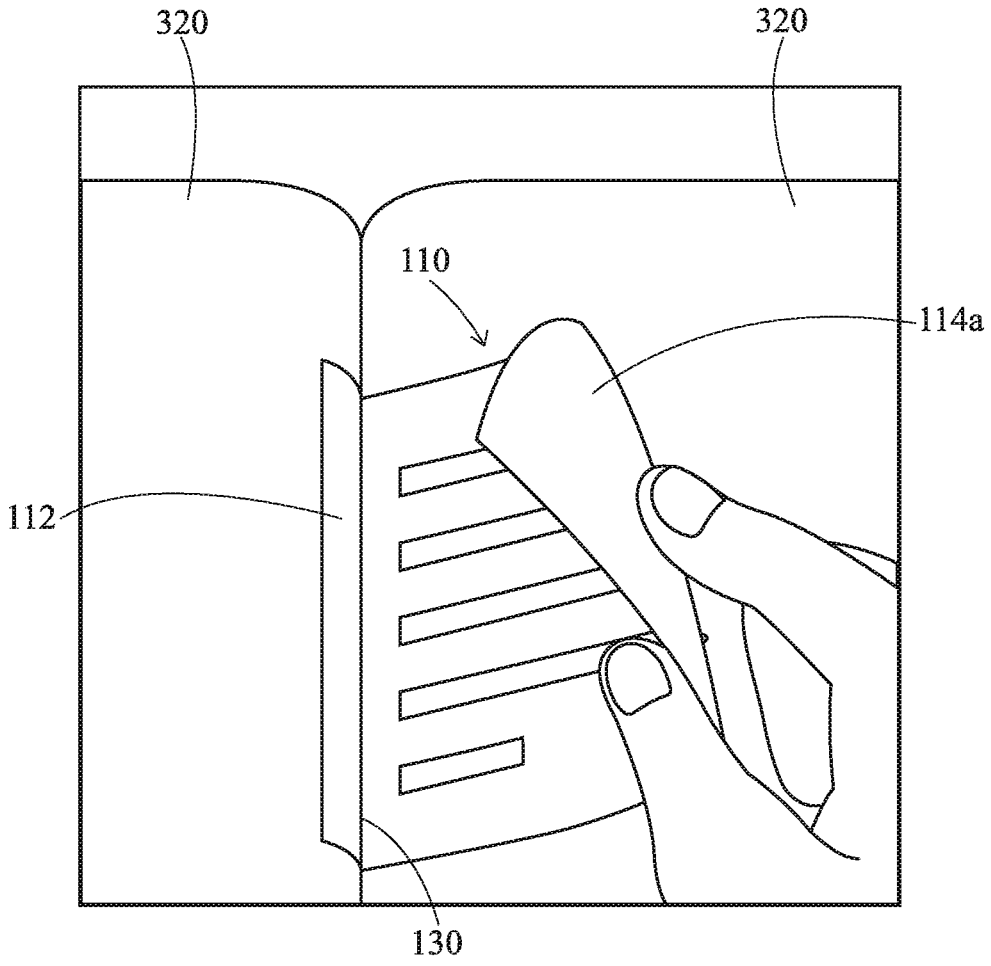
FIG. 7 is a schematic view illustrating the use of the creased sticky note of the present invention when the sticky body of the creased sticky note is a page-turn sticky note.

It shall be particularly appreciated that in addition to the aforesaid rectangular shape, the bookmark sticky note 210 of the present invention may also have other shapes in appearance. As shown in FIG. 7, the sticky body 110 of the creased sticky note 100 of the present invention may also be a "page-turn sticky note."

In detail, in the aspect shown in FIG. 7 where the sticky body 110 is the "page-turn sticky note", only a single crease 130 is disposed between the adhesion portion 112 and the flexible portion 114. In this case, by bending the crease 130 and positioning the crease 130 exactly at the joint of two specific pages 320 of the book 300, the sticky note can be adhered without covering the contents of the book. Furthermore, as shown in FIG. 7, key points can be marked on the front and back sides of the flexible portion 114, thereby improving the utilization rate for writing of the sticky note.

It shall be appreciated that in addition to the rectangular shape shown in FIG. 1, the creased sticky note of the present invention may also have other shapes such as a triangular shape, a circular shape, a square shape or other irregular shapes or a combination thereof in appearance, so the aforesaid shapes or the combination thereof in appearance all belong to the scope claimed by the creased sticky note of the present invention.

According to the above descriptions, with the arrangement of the at least one crease of the creased sticky note of the present invention, the flexure will not extend to the adhesive layer when the sticky note begins to flex from the corner that is not provided with the adhesive layer, thereby effectively preventing the sticky note from coming off the surface of a specific object after a long time of use in the prior art. Moreover, with the arrangement of the at least one crease of the creased sticky note of the present invention, the flexible portion can be allowed to bend for 90 degrees or 180 degrees along the at least one crease and the flexure occurring after the flexible portion is bent does not extend to the adhesive layer even if there is only a small area of adhesive layer.

Accordingly, the creased sticky note 100 of the present invention will have the following advantages during use:

reducing the bending tension of the flexible portion, thereby maintaining a durable and stable viscosity in the adhesion portion; • reducing the area of the adhesive layer while still maintaining the adhesion strength of the sticky note (the adhesion portion of the sticky note currently available on the market needs a width of about more than 12 mm to be adhered effectively, but the width of the adhesion portion in the present invention can be lowered to 3 mm by providing the crease while still maintaining the adhesion strength and the stability);

with the crease, the sticky note is capable of being folded easily so that it is more convenient for the flexible portion to be used in a page-turn mode or a double-sided mode. Meanwhile, due to the reduction of the adhesion portion, the writable space on the back flexible portion is enlarged; and by reducing the area of the adhesion portion, the sticky note can be used between lines of an article, for taking notes and for marking without influencing the reading of the underlying paper article because it can be easily folded.

Additionally, when the at least one crease is formed by a perforation cutter, the creased sticky note of the present invention has the following advantages: (1) the flexible portion of the sticky body is easily folded along the at least one crease; (2) the flexible portion of the sticky body can be easily torn off while the adhesion portion of the sticky body remains; and (3) the sticky note can be capable of being bent along the at least one crease so that the flexible portion of the sticky body has many use modes such as the more stable page-turn use mode.

The above disclosure is related to the detailed technical contents and inventive features thereof. People skilled in this field may proceed with a variety of modifications and replacements based on the disclosures and suggestions of the invention as described without departing from the characteristics thereof. Nevertheless, although such modifications and replacements are not fully disclosed in the above descriptions, they have substantially been covered in the following claims as appended.

What is claimed is:

1. A crease sticky note, comprising:

a sticky body, having an adhesion portion and a flexible portion disposed adjacent to the adhesion portion, the flexible portion including a front side and a back side;

an adhesive layer, disposed on the adhesion portion; and at least one crease, disposed on the adhesion portion, or between the adhesion portion and the flexible portion, or on a stress hinders area of the flexible portion which is near the adhesion portion, wherein the at least one crease is formed by a perforation cutter, and wherein the flexible portion has a writable area including both of the front and back sides of the flexible portion.

2. The crease sticky note of claim 1, wherein when the at least one crease is disposed on the stress hinders area of the flexible portion, the stress hinders area of the flexible portion is near the adhesion portion, and the stress hinders area has a width of 1 mm to 10 mm.

3. The crease sticky note of claim 1, wherein the adhesive layer is an adhesive layer capable of being adhered repeatedly.

4. The crease sticky note of claim 1, wherein the adhesive layer disposed on the adhesion portion has a specific width.

5. The crease sticky note of claim 4, wherein the specific width ranges between 3 mm to 20 mm.

6. The crease sticky note of claim 4, wherein the specific width is 5 mm, 7 mm or 10 mm.

7. The crease sticky note of claim 1, wherein the sticky body is a page-turn sticky note, a bookmark sticky note, a pamphlet sticky note or an index sticky note.

8. The crease sticky note of claim 7, wherein the adhesion portion of the bookmark sticky note is adapted to be adhered to a front cover or a back cover of a book via the adhesive layer, and the flexible portion is adapted to be bent so as to be inserted into a specific page of the book for marking.

9. The crease sticky note of claim 7, wherein the flexible portion of the bookmark sticky note further has a bent section and an inserting section that have different shapes and appearances from each other.

* * * * *